United States Patent [19]

Sinn et al.

[11] 4,093,118

[45] June 6, 1978

[54] CENTRIFUGE, PARTICULARLY FOR USE WITH AUTOMATIC ANALYSIS APPARATUS, ESPECIALLY FOR CHEMICAL, BIOLOGICAL, OR MEDICAL USE

[75] Inventors: Hartmut Sinn; Dieter Schröder; Hans Stallmann, all of Osterode am Harz, Germany

[73] Assignee: Heraeus Christ GmbH, Osterode am Harz, Germany

[21] Appl. No.: 802,372

[22] Filed: June 2, 1977

[30] Foreign Application Priority Data

Jun. 16, 1976 Germany ..... 2626910

[51] Int. Cl.[2] ..... B04B 5/02; B04B 9/12

[52] U.S. Cl. ..... 233/26

[58] Field of Search ..... 233/26, 27, 28, 25, 233/1 R

[56] References Cited

U.S. PATENT DOCUMENTS

| | | | |
|---|---|---|---|
| 3,797,737 | 3/1974 | Kadotani et al. | 233/27 |
| 3,951,334 | 4/1976 | Fleming et al. | 233/26 |
| 4,010,892 | 3/1977 | Revillet et al. | 233/26 |

FOREIGN PATENT DOCUMENTS

| | | | |
|---|---|---|---|
| 1,782,602 | 3/1972 | Germany | 233/26 |
| 296,421 | 4/1954 | Switzerland | 233/26 |
| 505,446 | 5/1939 | United Kingdom | 233/26 |

*Primary Examiner*—George H. Krizmanich
*Attorney, Agent, or Firm*—Flynn & Frishauf

[57] ABSTRACT

To permit light-weight construction of a rotor of a centrifuge holding sample carriers adapted to retain probes, the rotor is formed at its outer circumference with a sleeve of at least partly fiber-reinforced plastic. The holders are secured to the rotor and movable in guide means so that when swinging outwardly under centrifugal force, they can abut against the outer sleeve, preferably with interposition of a segmental element to provide for large area contact, the fiber-reinforced plastic sleeve, being continuous and circular, absorbing centrifugal forces.

12 Claims, 3 Drawing Figures

Figure 1:
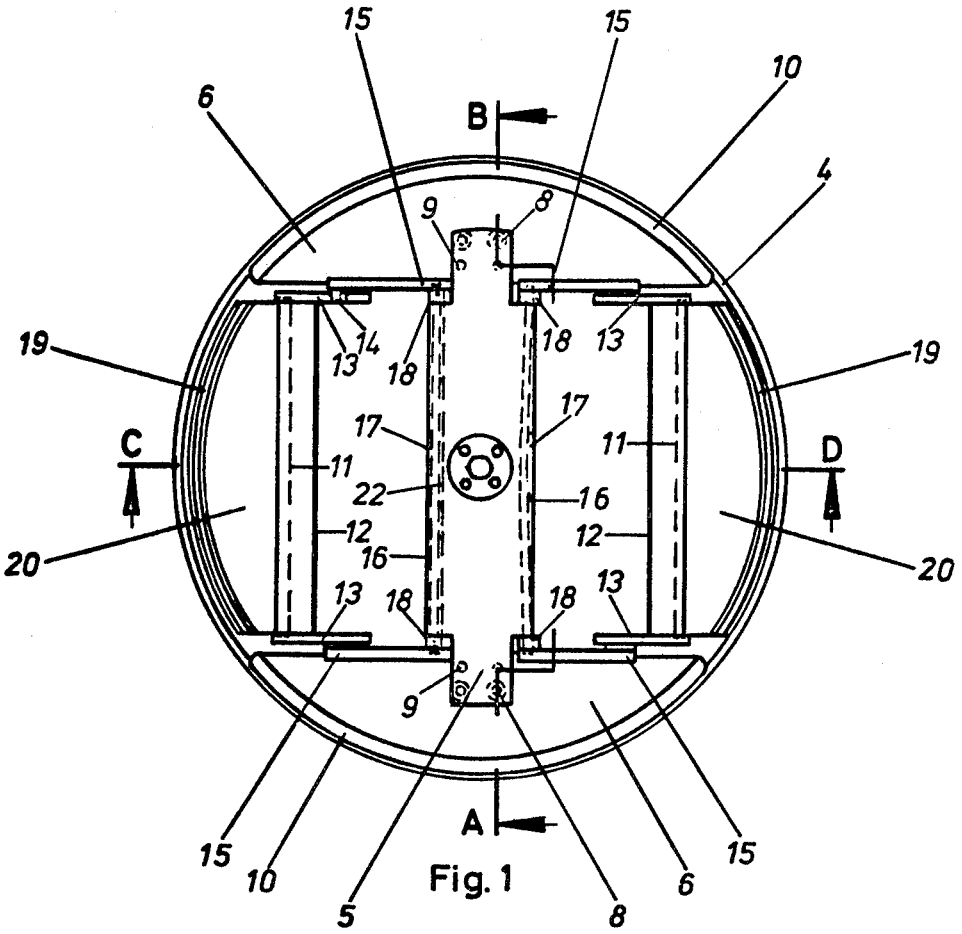

CENTRIFUGE, PARTICULARLY FOR USE WITH AUTOMATIC ANALYSIS APPARATUS, ESPECIALLY FOR CHEMICAL, BIOLOGICAL, OR MEDICAL USE

The present invention relates to a centrifuge, and more particularly to a centrifuge for combination with automatic analysis structures or systems, in which holders are provided to carry sample carriers, each adapted to hold probes, and especially to such centrifuges which can operate at high speed.

In laboratories for investigation of physics, chemistry, biochemistry, medicine, and in other clinical fields, it is customary to use analysis apparatus which includes centrifuges. Automatic analysis apparatus can test substances in a plurality of sample probes. It is customary to associate the sample probes together in common probe carriers or in carrier racks or assemblies. These carriers or carrier racks can be inserted in the automatic analysis apparatus and should also be acceptable by the centrifuge. Stiff carrier racks which can accept ten or more sample probes have been known; it has also been proposed to associate sample probes together in the form of a chain or a belt which can be secured to a plate or tray and then to introduce the plate or tray into the centrifuge forming part of the analysis apparatus.

The overall time required to carry out analyses should not be extended by long time required for centrifuging. It is therefore necessary to provide a centrifuge rotor which can operate at high speed and reach its operating speed quickly. The centrifuge, as a portion of the automatic analysis apparatus, raises a problem, however, in that rotors in which movable, typically pivotable holders are used must be constructed of high-strength material and with a particularly high-strength design in order to accept the forces applied on the rotor by the centrifugal force acting on the probes and on the probe holders or carriers. These forces are particularly bending forces which arise upon pivoting of the probe carriers, and the holders therefor, on the rotor of the centrifuge.

The pivoting axes of pivotable carriers may be a fair distance apart in order to accommodate carriers for probes of substantial lateral extent, so that more probes can be located on any given carrier. The position of the pivot axes for holders for such carriers away from the center of rotation causes high bending forces to be applied to the rotor. The holders then will operate at a comparatively wide radius and, upon acceleration, high centrifugal forces are transferred to the rotor from the pivot pins which form the pivot for the pivotable sample carriers. If the sample carriers for the samples are made of metal, the forces transferred to the centrifuge may well exceed 4000 times the weight of the carrier. If the pivot pins for the pivotable holders or carriers alone have to accept such forces, then design difficulties arise since the space for the placement of such pivot pins, even if they are made of high-strength, specially selected materials, is no longer available on the rotor itself.

Increasing the size of the rotor, and its weight, particularly in order to accept forces transferred by the carrier pins to the rotor, results in high inertia and excessively long acceleration and deceleration times. Increasing the weight of the rotor also causes difficulty with replacement or repositioning of the rotor.

It is an object of the present invention to provide a centrifuge which is particularly adapted for combination with an automatic analysis system and which can accept wide area carriers for sample probes, and is suited for high-speed operation.

SUBJECT MATTER OF THE PRESENT INVENTION

Briefly, the rotor is constructed to have these characteristics: It is formed with a sleeve or ring made at least in part of a fiber reinforced plastic material; the pivot axes of the sample carrier holders are guided horizontally in guide tracks and, upon pivoting deflection of the sample holders, the holders themselves bear against the fiber-reinforced sleeve or ring so that forces arising upon rotation of the rotor are directly transferred to the sleeve or ring.

Such a centrifuge has the advantage that the time for centrifuging can be substantially reduced since the acceleration and deceleration time can be short; the plastic fiber-reinforced outer sleeve or ring has high strength and low weight. It is no longer necessary to accept all centrifugal forces on the pivot pins themselves. Since the forces applied to the axis of the rotor are no longer concentrated on pivot pins, the overall construction can be made light-weight, resulting in low inertia while still permitting operation at high speed, for example 5000 rpm. The light-weight construction also permits ready portability, and interchange or replacement of the rotors by personnel within the laboratories for which the rotor is particularly developed.

Figure 2:
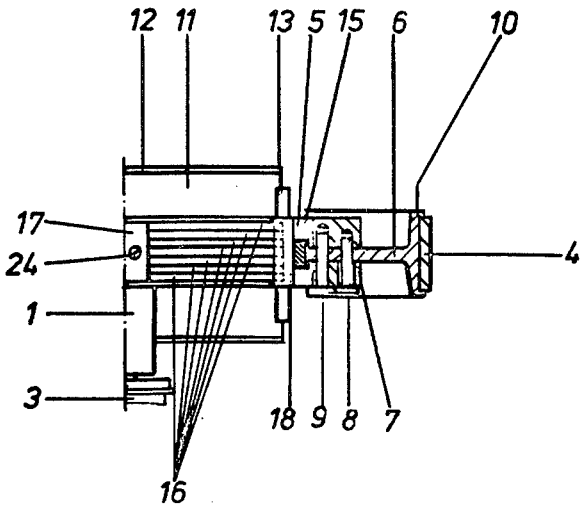
Figure 3:
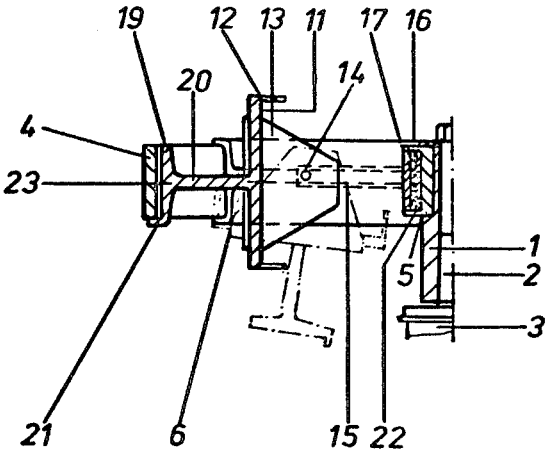

Drawings, illustrating an example:

FIG. 1 is a schematic top view of the rotor with rotor holders secured therein;

FIG. 2 is a schematic half cross section along line A-B, wherein it is to be noted that the section line A-B is offset and does not pass through the center of the rotor, but rather is angled to show a portion of the section through the sample holder; and FIG. 3 is a schematic half-sectional view along line C-D, passing through the center of the rotor and illustrating, in full lines, the position of the sample holder when in operation, and in chain dotted lines when stopped.

The rotor has a hub 1 seated on a shaft 2 (FIGS. 2, 3) of a suitable drive element, for example an electric motor. A cross brace or cross bar 5 extends diametrically across the rotor. Segmental elements 6 are connected to the outer ends of the cross bar 5 by screws 8 and by pins or bolts 9. The segmental elements 6 retain a ring-shaped sleeve 4 thereon. The ring-shaped sleeve 4 is made of a fiber-reinforced plastic. High-strength fibers are embedded in plastic matarial or are impregnated therewith. Suitable fibers are glass fibers, boron fibers, carbide or carbon fibers in high polymer resin plastic materials. The fibers or filaments are so wound that a ring is formed which, then, forms the sleeve or surrounding portion of the rotor of the centrifuge.

As best seen in FIG. 2, the segments 6 are of generally T-shaped profile when in cross section. They are secured at the end portion 7, for example in a recess, by the screws and bolts 8, 9. The radially outer ends of the segments 6 are formed with a flange 10 which partly surrounds the ring-shaped sleeve 4 to prevent shift of the sleeve 4 in axial direction, that is, vertically in FIGS. 2 and 3.

The holders 11, which provide a wide support surface for probe carriers are illutrated in FIGS. 1 and 3 in their extended position, that is, when the centrifuge is operating at nominal speeds, in full lines; the chain-dotted representation in FIG. 3 illustrates the holders when the centrifuge is stopped, in which the holders are pivoted about their pivot axes by about 90° i.e. are suspended from pivot pins 14 to hang down by gravity. The pivoting preferably is slightly less, as seen in FIG. 3.

The wide area or large surface holders 11 are arranged to accept one or more carriers, each of which can hold a plurality of sample probes. The carriers, in the form of holding plates, bolts or the like, are standard and well known. The carriers have been omitted from the illustration for simplicity. The holders 11 secure the carriers thereon by engagement flanges 12 and lateral portions 13 and secure the carriers reliably so that, even upon movement of the holder 11 and high-speed operation of the centrifuge, the carriers cannot escape and will be securely held therein.

The holders 11 are horizontally movable. They are formed with pivot pins 14 defining pivot axes for pivotal movement. The pivot pins 14 may be relatively thin pins, that is, pins of for example 10 mm or less. The pins are screwed into rails 15. The rails 15, as best seen in FIG. 2, are generally U-shaped and are slidably secured against the inner surfaces of the segmental portions 6 to permit horizontal sliding movement of the guide rails, that is, inwardly and outwardly with respect to the center of rotation of the centrifuge. The rails 15 can move outwardly under centrifugal force applied by the pins 14, that is, when the centrifuge is in operation and particularly when it is operating at high speed. A plurality of springs 16, which may be spring pins or leaf springs, provide radially inwardly directed bias against the rails 15. When the centrifuge is stopped, the rails 15 engage against facing edges of the cross bar 5 (as seen at the left half of FIG. 1). In operation of the centrifuge, and particularly under high-speed operation, the guide rails 15 can travel radially outwardly in the tracks formed on the inside surface of the segments 6, the springs 16 bowing slightly outwardly to still, resiliently, retain the tracks 15, and hence pins 14 and holders 11 under resilient bias force towards the center of the centrifuge. The bending of the springs 17 is illustrated at the right half of FIG. 1.

Spring pins or leaf springs 16 are held in position by an attachment washer 17 located close to the center of the centrifuge and secured to the hub 1 (FIGS. 1, 3). One or more screws 24 (FIG. 2) passing through the washer or holding plate 17 secure the leaf spring 16 in position. The springs 16 preferably are assembled stacked packages or batteries of spring elements, for example assembled spring rods; one or more leaf springs may also be used. The packages or leaf or rod springs are located in recesses 22 of the cross member 5 (see FIG. 3). The free ends of the springs 16 are guided in notched guide strips 18, located perpendicularly to the tracks 15, that is, parallel to the shaft 2 of the rotor. The ends of the springs 16 extend through the grooves and into the guide tracks 15 and engage the guide tracks 15 on the radially inner portion thereof, while permitting horizontal movement (with respect to FIGS. 2, 3) of the tracks 15.

The arrangement permits radially inward and outward movements of the holders 11 through a short distance. The radially outward movement is possible only until the segmental end portions 19, that is the outer portions of holders 11 of support elements 23, secured to the holders 11, engage the ring or sleeve 4. The horizontal position of the holders 11 is best seen in FIG. 3 (full line). The support elements 23 have a center web 20, and the segmental end portions are formed with an overlapping stop formed by bent-over end 21. The stop 21 limits the pivoting movement of the holder carrier 11 in an upward direction.

Operation: When the centrifuge is stopped, the holders 11 hand through (FIG. 3- chain dotted position). The centrifuge is then set into rotation. As the speed increases, the centrifugal forces rise quadratically with speed. The holders will swing outwardly and with their outer, or bottom portion upwardly to the full-line position in FIGS. 1, 3. The centrifugal forces due to rotation of the centrifuge and resulting from the placement thereon of carriers and probes are now accepted by the sleeve or ring 4 against which the outer formerly bottom portion can bear. As best seen in FIG. 3, the support elements 23 engage the ring 4 with the segmental end portions 19 so that no substantial bending stresses can occur at small localized positions of the carrier 11. The remaining constructional elements of the rotor, for example the cross member 5 and the balance segments 6 are loaded only slightly even under high-speed operation. The sleeve or ring 4, however, is heavily loaded due to the presence of the probe sample carriers, and the sample probes on holder 11. The fiber or filament-reinforced plastic sleeve or ring 4, however, is stressed only in tension and thus can accept high forces even though it, itself, is made of light-weight material and itself weighs only little. Thus, the design of the centrifuge rotor is no longer based on considerations of strength of the bearing pins 14 for the holders in which the sample probe carriers are to be inserted, and their location in the rotor itself.

Optimum force transfer and force distribution can be obtained by slightly deforming the sleeve 4 to form an oval, rather than an exact circle. This deformation which, since slight, is not visible in the drawing can be obtained by suitable shaping of the segments 6. As the centrifuge accelerates, the holders 11 will then initially engage the sleeve 4 only at the center of the segmental portion 19 since, at that point, the diameter of the ring or sleeve 4 will be less. As the full nominal speed is reached, and when the holders 11 are completely horizontally deflected, the sleeve 4 will become exactly circular.

The bearing pins 14 are preferably located beyond the longitudinal center axis of the holder 11. Offsetting the positon of the pivot axes for the holders 11 from the axis of symmetry results in the slightly inclined position shown in chain-dotted line in FIG. 3, departing from a purely vertical plumb line.

Various changes and modifications may be made; more than two holders 11 can be used, and the size of the holders themselves is not critical.

Various other changes may be made within the scope of the inventive concept.

We claim:

1. Centrifuge for substance analysis and for use with essentially flat sample carriers, each of which is adapted to carry a plurality of sample probes, comprising a rotor having an outer circumferential sleeve (4) of material including at least partly fiber-reinforced plastic;

a pivotably suspended and radially movable holder (11) for said sample carriers so that, when the centrifuge is stopped, the holders hang downwardly with their outer portion bottommost; and guide means (15) guiding said holders for radially outward movement toward said outer sleeve (4), said holders (11) being radially outwardly movable toward said outer sleeve, and, in operation of the centrifuge, the holders swinging into horizontal position due to centrifugal force, the outer portion thereof bearing against and being supported by said circumferential sleeve (4) when the holders are forced to pivot from the downward hanging position to extend radially outwardly due to centrifugal force arising in operation of the centrifuge.

2. Centrifuge according to claim 1, wherein each holder includes an attachment support element (19) having at least partly segmental form matching at least approximately the inner circumference of the sleeve (4), said support elements (19) being located at the outer portion of the holders (11) to provide large-area support counter-acting centrifugal forces applied to the holder (11) in operation of the centrifuge.

3. Centrifuge according to claim 1, further comprising spring means (16) resiliently engaging the holders (11) and biassing the holders into a radially inward position.

4. Centrifuge according to claim 3, wherein the spring means (16) comprises elongated leaf or rod springs.

5. Centrifuge according to claim 4, further comprising spring guide means (18) extending at least approximately parallel to the axis of rotation of the centrifuge, said spring guide means guiding the end portions of said leaf or rod springs and engaging the holder guide means (15) to bias the holder guide means in radially inward direction;

and attachment means (17) securing the spring means essentially centrally with respect to the axis of rotation of the centrifuge.

6. Centrifuge according to claim 3, further comprising a cross carrier (5) extending at essentially right angles to the guide means (15), said cross carrier being formed with a recess (22), the spring means (16) being at least in part located in said recess.

7. Centrifuge according to claim 1, wherein each holder (11) includes an attachment support element (19) having at least partly segmental form matching at least approximately the inner surface of the sleeve (4) to provide a bearing surface between the holder and the sleeve which extends over the segmental arc of the support element;

and an engagement stop (21) formed on said attachment support element (19) positioned to engage the sleeve (4) when, in operation of the centrifuge, the holders (11) and the attachment support element are moved into engagement with said sleeve, due to centrifugal force.

8. Centrifuge according to claim 7, wherein the sleeve (4) and the attachment support element, when the centrifuge is at rest, are of slightly different curvature to provide for engagement of the attachment support element (19) with the sleeve (4) centrally of the segment of the segmental attachment support element but engaging said sleeve essentially throughout the segmental circumference of the segmental support element when the centrifuge is at nominal centrifuging speed operation.

9. Centrifuge according to claim 2, wherein said sleeve, in top view, is slightly elliptical with the shorter axis coinciding with the axis of the segmental attachment support element to provide for central engagement only of the segmental support element with the sleeve (4) when the centrifuge is at rest, or under low speed operation, but permit deformation of the sleeve (4) to match the segmental form of the segmental attachment support element (19) upon outward movement of the holders (11) and consequent outward movement of the segmental attachment support element (19) when the centrifuge is at nominal speed operation.

10. Centrifuge according to claim 7, wherein the segmental support elements (19) include a carrier support portion (23) having, in cross section, generally I-beam shape.

11. Centrifuge according to claim 1, wherein the pivot holders (11) are pivoted in said holder means (15) at a position offset with respect to the axis of symmetry of said pivot holders to provide for inclined pivotal suspension of the holders (11) for the sample carriers, when the centrifuge is at rest, in a direction departing from the vertical.

12. Centrifuge according to claim 5, wherein each holder includes an attachment support element (19) having at least partly segmental form matching at least approximately the inner circumference of the sleeve (4), said support elements (19) being located at the outer portion of the holders (11) to provide large-area support counter-acting centrifugal forces applied to the holder (11) in operation of the centrifuge;

said sleeve (4), in top view, is slightly elliptical with the shorter axis coinciding with the axis of the segmental attachment support element to provide for central engagement only of the segmental support element with the sleeve (4) when the centrifuge is at rest or under low speed operation, but permit deformation of the sleeve (4) to match the segmental form of the segmental attachment support element (19) upon outward movement of the holders (11) and consequent outward movement of the segmental attachment support element (19) when the centrifuge is at nominal speed operation;

and wherein said sleeve (4) is ring-shaped and comprises a high polymer resin plastic with fibers embedded therein including at least one of: glass fibers, boron fibers, carbide fibers, carbon fibers.

* * * * *